US006750826B2

(12) United States Patent
Schultze et al.

(10) Patent No.: US 6,750,826 B2
(45) Date of Patent: Jun. 15, 2004

(54) SLOTTED ANTENNA

(75) Inventors: Ralf Schultze, Berlin (DE); Heinrich Wilken, Berlin (DE); Andreas Horn, Berlin (DE)

(73) Assignee: Robert Bosch GmbH, Stuttgart (DE)

( * ) Notice: Subject to any disclaimer, the term of this patent is extended or adjusted under 35 U.S.C. 154(b) by 41 days.

(21) Appl. No.: 10/069,821

(22) PCT Filed: Jun. 23, 2001

(86) PCT No.: PCT/DE01/02322

§ 371 (c)(1),
(2), (4) Date: Jun. 28, 2002

(87) PCT Pub. No.: WO02/01674

PCT Pub. Date: Jan. 3, 2002

(65) Prior Publication Data

US 2002/0171595 A1 Nov. 21, 2002

(30) Foreign Application Priority Data

Jun. 27, 2000 (DE) ..... 100 31 255

(51) Int. Cl.[7] ..... H01Q 13/10
(52) U.S. Cl. ..... 343/767; 343/769; 343/770
(58) Field of Search ..... 343/767, 770, 343/769, 700 MS

(56) References Cited

U.S. PATENT DOCUMENTS

| | | | | |
|---|---|---|---|---|
| 3,739,386 A | | 6/1973 | Jones | |
| 4,305,078 A | | 12/1981 | Jones et al. | |
| 5,703,601 A | * | 12/1997 | Nalbandian et al. | 343/700 MS |

FOREIGN PATENT DOCUMENTS

| | | |
|---|---|---|
| DE | 31 20 112 | 12/1982 |
| EP | 0 376 643 | 7/1990 |
| JP | 59 207705 | 11/1984 |
| JP | 02 209002 | 8/1990 |
| WO | WO 97 41619 | 11/1997 |

* cited by examiner

*Primary Examiner*—Hoanganh Le
(74) *Attorney, Agent, or Firm*—Kenyon & Kenyon

(57) ABSTRACT

A slotted antenna can be used for operation in multiple frequency ranges. The slotted antenna has a first electrically conducting disc which is offset from an electrically conducting base area which forms a reference potential, the disc being connected at its outside edge to the base area by at least one first electrically conducting web. The first disc includes a recess. Above the recess, a second electrically conducting disc is situated and is connected at its outside edge to the first disc by at least one second electrically conducting web. An antenna conductor leads to the second disc.

15 Claims, 1 Drawing Sheet

SLOTTED ANTENNA

FIELD OF THE INVENTION

The present invention relates to a slotted antenna.

BACKGROUND INFORMATION

PCT Publication No. WO97/41619 describes a combination flat antenna which combines a mobile radio antenna for an operating frequency of 900 MHZ and a GPS antenna (global positioning system). The mobile radio antenna is composed of a circular electrically conducting disc which is supplied with power at its midpoint and is situated above an electrically conducting base area. The circular disc is connected to the base area by three electrically conducting webs at the outside edge of the disc. This results in three slotted antennas arranged in a circle. The GPS antenna is designed as a patch antenna and is situated on the circular disc so that the two antennas may be combined in one compact design.

SUMMARY OF THE INVENTION

The slotted antenna according to the present invention has the advantage over the related art that the first disc includes a recess; a second electrically conducting disc is situated above the recess and is connected at its outer edge to the first disc by at least one second electrically conducting web; and an antenna conductor leads to the second disc. This makes it possible to implement a cascaded slotted antenna which requires only a single common feed via the antenna conductor. Thus, it is possible to manufacture a radio antenna for two or more frequency ranges in an efficient and space-saving design. A GPS patch antenna may be additionally situated on the second disc. Because of the supplementation according to the present invention of the slotted antenna known from the publication cited above by adding at least one extra resonator, it is possible to stack a plurality of such resonators in a compact design. approximately circular perimeter. In this way, an omnidirectional diagram without a preferred direction may be implemented as the directional characteristic of the slotted antenna.

One advantage is also that at least one of the discs is designed not with a circular perimeter but instead in the form of an n-sided, oval, elliptical or asymmetrical shape, for example. This yields a distorted directional characteristic having preferred directions for the slotted antenna. This distortion of the directional characteristic may be used in a controlled manner for compensation of ambient influences. Thus, for example, distortion of the directional characteristic of such a slotted antenna situated on a motor vehicle due to struts or roof edges of the vehicle may be counteracted so that an approximately omnidirectional diagram without preferred directions is again obtained with the superpositioning of the distortion formed by the selected shape of the discs on the distortion due to the struts or roof edges.

Another advantage of discs designed to have a circular perimeter is that the circular area of the recess of the first disc is smaller than the circular area of the second disc. In this way, with a concentric arrangement of discs and the recess and with webs situated perpendicular to the discs, a flatter emission in the elevation radiation diagram may be implemented. Due to a concentric arrangement of the two discs, it is possible to implement concentric directional characteristics for the resonators based on the two discs.

It is especially advantageous that three webs are situated between the first disc and the base area, and three webs are likewise situated between the first disc and the second disc. In this way, each of the two resonators is designed as a multiple slotted antenna which implements a relatively high transmission and/or reception bandwidth.

It is especially advantageous that the webs between the base area and the first disc are mutually rotated by 60° with respect to the webs between the first disc and the second disc. This minimizes any mutual influence of the two resonators. Then the current and voltage peaks occurring at the resonators do not coincide but instead are offset electrically by 180°. Therefore, this yields a current assignment which permits good emission at the operating frequency of each of the two resonators.

It is especially advantageous that at least one third disc, which also includes a recess, is provided between the first disc and the second disc; the third disc is connected to the outside edge of the directly adjacent disc above it by at least one third web which corresponds in particular to the at least one second web and is connected to the directly adjacent disc beneath it by at least one fourth web at its own outside edge. This permits implementation of a slotted antenna having more than two resonators, each being resonant in a different frequency range, so that a multi-band antenna having more than two frequency ranges for emission and/or reception of signals may be implemented. A compact and space-saving design is possible by stacking the resonators one on top of the other.

DETAILED DESCRIPTION

Figure 1:
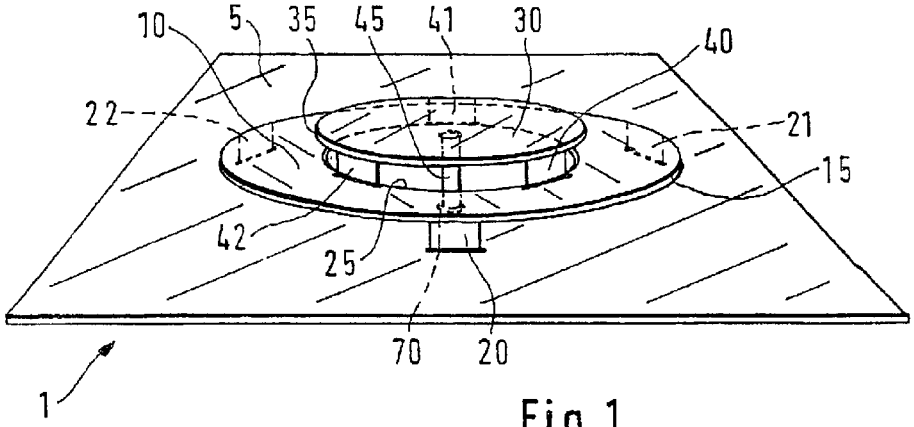
FIG. 1 shows a first embodiment of a slotted antenna according to the present invention.

FIG. 1 shows a slotted antenna 1 which includes a first electrically conducting disc 10 which is offset from an electrically conducting base area 5 which forms a reference potential. First disc 10 has an approximately circular outside edge 15. Because of a concentric and approximately circular first recess 25, it is designed with an annular shape. First disc 10 is connected at its outside edge 15 to base area 5 by a first electrically conducting web 20, a fourth electrically conducting web 21 and a fifth electrically conducting web 22. These webs 20, 21, 22 are approximately perpendicular to first disc 10 and to base area 5 and are each offset by approximately 120° relative to one another. A slotted antenna element is thus formed between two adjacent webs. First disc 10, said webs 20, 21, 22 and base area 5 thus form a first resonator element having three slotted antenna elements for emission and/or reception of radio signals in a first frequency range having a first operating frequency of approximately 900 MHZ, for example, as the mid-frequency of the first frequency range. The diameter of outside edge 15 of first disc 10 is to be selected so that the slotted antenna elements formed by three webs 20, 21, 22 each has a length amounting to approximately half the first operating wavelength. The length of the respective slotted antenna element corresponds to the length of outside edge 15 of first disc 10 between two successive webs.

According to FIG. 1, a second electrically conducting disc 30 situated above first recess 25 is designed as a circle and is arranged concentrically to first disc 10 and first recess 25. Its diameter corresponds approximately to the diameter of first recess 25. Second disc 30 is connected at its outside edge 35 to first disc 10 by a second electrically conducting web 40, a sixth electrically conducting web 41 and a seventh electrically conducting web 42, and second web 40, sixth web 41 and seventh web 42 are also approximately perpendicular to second disc 30 and first disc 10. Second web 40, sixth web 41 and seventh web 42 then contact first disc 10 at the edge of first recess 25. Together with second web 40, sixth web 41, seventh web 42 and first disc 10, second disc 30 forms a second resonator element of slotted antenna 1. Second web 40, sixth web 41 and seventh web 42 are also situated with a mutual offset of approximately 120°. As is the case with the first resonator element, again a slotted antenna element is formed between adjacent webs of the second resonator element. The first resonator element and the second resonator element thus each have three slotted antenna elements. Since the diameter of second disc 30 corresponds approximately to the diameter of first recess 25, the diameter of second disc 30 is smaller than the diameter of first disc 10, so that for the second resonator element, a smaller slot length is achieved for the three slotted antenna elements there. The second resonator element thus has a resonance at a second operating frequency which is greater in comparison with the resonance of the first resonator element at the first operating frequency and represents the mid-frequency in a second frequency range for emission and/or reception of radio signals. The slot length of the slotted antenna element of the second resonator element, i.e., the distance between two successive webs of the second resonator element, is thus spaced approximately half a second operating wavelength apart, the length of the outside edge of second disc 30 between adjacent webs of the second resonator element forming this distance and being approximately equal to half the second operating wavelength.

An antenna conductor 45 leads to second disc 30 over an aperture 70 in base area 5 which is small in comparison with first recess 25, and approximately at the center of second disc 30 the conductor is electrically connected to it. However, antenna conductor 45 is not connected to first disc 10.

On the basis of the two resonator elements described here, it is possible to operate slotted antenna 1 in two different frequency ranges for sending and/or transmitting radio signals. The second operating frequency may be approximately 1800 MHZ, for example. Due to the circular arrangement of first disc 10, second disc 30 and first recess 25 as well as the use of three webs, each being offset by approximately 120° from the others, per resonator element, each of the two resonator elements of slotted antenna 1 has a rotationally symmetrical directional characteristic in the form of an omnidirectional diagram having vertical polarization. The respective radiation diagram in the vertical and horizontal planes corresponds to that of a monopole, e.g., a lambda/4 transmitter. In addition, slotted antenna 1 according to FIG. 1 has an extremely small overall height. Nevertheless, slotted antenna 1 has a relatively high bandwidth for the two frequency ranges due to its design having three slots per resonator element.

In the example described so far, webs 20, 21, 22 of the first resonator element are situated on outside edge 15 of first disc 10, and webs 40, 41, 42 of the second resonator element are situated on outside edge 35 of second disc 30. The webs may also be situated closer to the respective midpoint of the disc in the area of outside edge 15, 35 of the respective disc.

Base area 5 forms a reference potential for the first resonator element, whereas the second resonator element uses the first resonator element together with base area 5 as the reference potential. With a suitable design and dimensions of webs 20, 21, 22 of the first resonator element and webs 40, 41, 42 of the second resonator element, it is possible to achieve a resonance having the same impedance at the feed point of slotted antenna 1, i.e., at the connecting point of antenna conductor 45 approximately at the center of second disc 30 and thus at the 'head point' of slotted antenna 1 for both operating frequencies, and the impedance at the base point, i.e., at the connecting point between antenna conductor 45 and a continued antenna cable connected to it may amount to 50 Ω, for example. The connecting point is situated approximately in the plane of base area 5. Thus, an additional supply network for impedance matching is not necessary for either of the two resonator elements.

As shown in FIG. 1, webs 20, 21, 22 of the first resonator element may be offset by approximately 60° with respect to webs 40, 41, 42 of the second resonator element or rotated with respect to the common longitudinal axis of first disc 10 and second disc 30. In this way, the current and voltage peaks occurring at the two resonator elements do not coincide but instead are in phase opposition by 180°. This results in a current assignment which permits good emission at both operating frequencies. This minimizes any mutual influence of the two resonator elements.

In addition, the circular area of first recess 25 may be smaller than the circular area of second disc 30. In this way, the inside edge of first disc 10 is pulled inward beneath outside edge 35 of second disc 30 in the direction of the longitudinal axis of both discs 10, 30, although without contacting antenna conductor 45 at the center of slotted antenna 1. Webs 40, 41, 42 of the second resonator element then contact first disc 10 at a location farther away from the inside edge of first disc 10 than in the case when the circular area of second disc 30 and the circular area of first recess 25 are approximately the same size. This results in a flatter directional characteristic for the second resonator element in the elevation radiation diagram.

Because of its flat design, slotted antenna 1 described here is suitable both as a surface-mounted antenna, e.g., on a motor vehicle, and for installation in a trough of electrically conducting material. In both cases, slotted antenna 1 may be provided with a cover of a dielectric material. Possible installation positions for slotted antenna 1 on a motor vehicle include the roof of the vehicle, the trunk lid and optionally also the front hood.

Using slotted antenna 1 described here, transmission and/or reception operation in two different frequency ranges is possible with a very small installation height and without any additional power supply network.

In the example described in FIG. 1, each resonator element includes three slots. However, this is just one example of an arrangement. More slots or fewer slots may also be provided, but in any case two adjacent webs must be situated at a distance of approximately half an operating wavelength from one another, the distance being measured across the outside edge of respective disc 10, 30. With an arrangement of a resonator element having only one web, the slot runs from one free edge of the web to the other free edge of the web, and a dielectric mounting element opposite the web might be used for mechanical support of the respective disc of the resonator element. Again in this case, the distance between the two free slot ends, defined over the outside edge, and thus the length of the slot must correspond approximately to half the operating wavelength of the resonator element. It is also possible for the first resonator element and the second resonator element to be provided with a different number of webs and thus slots. However, the design having three slots per resonator element offers an optimal balance between the complexity, due to the size, the use of materials and the cost, and the achievable benefit in the form of the obtainable bandwidth in the respective frequency range. The design of a resonator element having three slots, each having a length of half an operating wavelength, yields a diameter of the respective disc amounting to approximately half the operating wavelength. This prevents antenna emission upward in the elevation diagram. Emission is thus primarily horizontal.

Slotted antenna 1 having two resonator elements according to FIG. 1 may be used for mobile radio applications, e.g., in the 900 MHZ and 1800 MHZ frequency bands of the GSM mobile wireless network (global system for mobile communications), the first resonator element being provided for sending and receiving radio signals in the 900 MHZ frequency band, and the second resonator element being provided for sending and receiving radio signals in the 1800 MHZ frequency band.

The concentric design of slotted antenna 1 described here as well as the circular design of outside edge 15 of first disc 10 and outside edge 35 of second disc 30 offer the advantage of a rotationally symmetrical directional characteristic having an azimuthal omnidirectional diagram. However, non-concentric arrangements of the two resonator elements and designs having a non-circular arrangement of outside edges 15, 35 of two discs 10, 30 are also possible. For example, slotted antenna 1 may also be implemented with an n-sided shape, e.g., a triangular or rectangular shape, an oval or elliptical shape or even an asymmetrical shape of outside edges 15, 35 of discs 10, 30, and in the case of the n-sided design, the corners may also be rounded. Such a slotted antenna 1 thus has a distorted azimuthal omnidirectional diagram having preferred directions for each of the two resonator elements. Such distortion of the azimuthal omnidirectional diagram may be used in a controlled manner for compensation, given appropriate dimensioning of outside edges 15, 35. Thus, in the case of an installation on a motor vehicle, for example, if distortion of the radiation diagrams of the resonator elements of slotted antenna 1 is caused by struts or roof edges of the motor vehicle, this distortion may be counteracted, so that it is compensated by the distortion predetermined by the given distorted azimuthal omnidirectional diagram, so that an approximately rotationally symmetrical omnidirectional diagram without any preferred direction is again obtained.

It is also possible to provide for only one of two discs 10, 30 to have its outside edge 15, 35 in the form of an n-sided shape, an oval or elliptical shape or an asymmetrical form, while the other of two discs 10, 30 has an approximately circular perimeter. In this case, only the directional characteristic of the resonator element of the disc having the non-circular outside edge is a distorted azimuthal omnidirectional diagram having preferred directions, whereas the directional characteristic of the resonator element of the disc having the circular outside edge is an azimuthal omnidirectional diagram without preferred directions. It is also possible for the two resonator elements to each have a disc having a differently shaped outside edge without this being a circular outside edge, so that the two resonator elements have different directional characteristics having differently distorted azimuthal omnidirectional diagrams and preferred directions. In addition, it is also possible for first recess 25 not to be circular but to also be in the form of an n-sided, oval, elliptical or asymmetrical shape.

Slotted antenna 1 described here may also be used in two different frequency ranges, so that a first frequency range is provided for a first mobile radio network, e.g., the GSM mobile radio network, and a second frequency range is provided for a second mobile radio network, e.g., the E-net, and radio signals may be sent and received by using slotted antenna 1 in the corresponding frequency bands.

Accordingly, one of the frequency bands may also be provided for a UMTS mobile radio network (universal mobile telecommunications systems).

Figure 2:
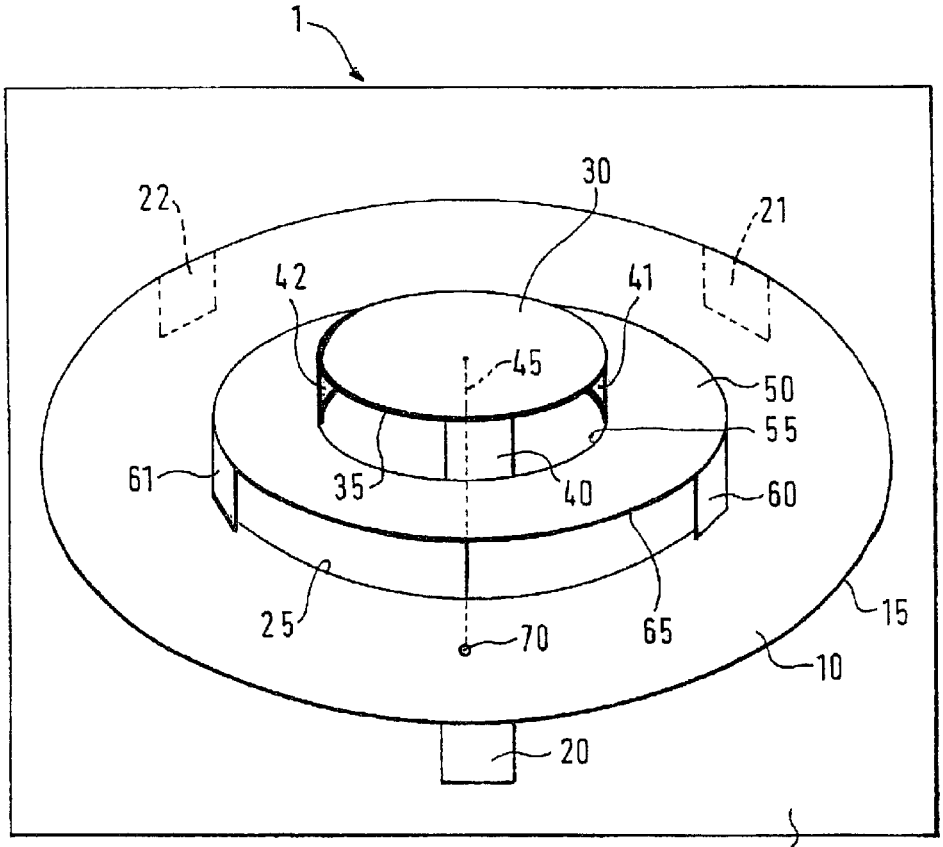
FIG. 2 shows a second embodiment of a slotted antenna according to the present invention.

However, as illustrated in FIG. 2, more than two resonator elements may also be provided in slotted antenna 1 for implementation of more than two frequency bands for sending and/or receiving radio signals. In FIG. 2, the same reference notation is used for the same elements as in FIG. 1. A third electrically conducting disc 50 is situated between first disc 10 and second disc 30, and it also has a circular outside edge 65 and is situated concentrically to first disc 10 and second disc 30. Third disc 50 has a diameter corresponding approximately to the diameter of first recess 25. Third disc 50 is connected at its outside edge 65 to first disc 10 beneath it by a fourth web 60, an eighth web 61 and a ninth web (not shown in FIG. 2), with third disc 50, fourth web 60, eighth web 61, ninth web and first disc 10 forming a third resonator element. Webs of the third resonator element are approximately perpendicular to first disc 10 and third disc 50. Each is offset by approximately 120° relative to the one another, so that again three slots are formed for the third resonator element. Since the diameter of third disc 50 is smaller than the diameter of first disc 10, the third resonator element will have a resonance at a third operating frequency which is greater than the first operating frequency. The distance between two adjacent webs of the third resonator element across outside edge 65 of third disc 50 again corresponds approximately to half the third operating wavelength.

Third disc 50 in turn has a second recess 55 which is concentric with first disc 10 and second disc 30, this recess being circular, and second disc 30 together with second web 40, sixth web 41 and seventh web 41 are situated above it in the manner already described with respect to FIG. 1, the diameter of second disc 30 corresponding approximately to the diameter of second recess 55. Second disc 30 together with second web 40, sixth web 41 and seventh web 42 and third disc 50 then form the second resonator element whose operating frequency is greater than the third operating frequency accordingly.

Slotted antenna 1 may thus be implemented with three different frequency bands for sending and/or receiving radio signals. Slotted antennas having four or more resonator elements for four or more frequency ranges may also be implemented accordingly. As also described in conjunction with the embodiment according to FIG. 1, the diameter of first recess 25 and/or the diameter of second recess 55 may also be smaller than the diameter of the disc above it to achieve a flatter emission in the elevation radiation diagram of the third resonator element and/or the second resonator element.

Slotted antenna 1 may also be operated at a number of different frequency ranges for sending and/or receiving radio signals corresponding to the number of discs 10, 30, 50 used in the antenna, the operating frequency of the respective resonator element depending on the slot length at outside edge 15, 30, 65 of respective disc 10, 30, 50. According to FIGS. 1 and 2, the diameter of a disc is larger, the smaller the distance from base area 5.

In the embodiment according to FIG. 2, antenna conductor 45 passes through the center of orifice 70 in base area 5, first recess 25 and second recess 55 of second disc 30 and is electrically connected to the latter. The second resonator element uses the third resonator element and the first resonator element together with base area 5 as the reference potential.

The third resonator element uses the first resonator element and base area 5 as the reference potential. The first resonator element uses base area 5 as the reference potential.

Third disc 50 and first disc 10 do not come in contact with antenna conductor 45. The first resonator element in the embodiment according to FIG. 2 is designed like the first resonator element in the embodiment according to FIG. 1. In the embodiment according to FIG. 2 as well as in the embodiment according to FIG. 1, antenna conductor 45 passes through orifice 70 in base area 5 without coming in contact with base area 5.

In the embodiment according to FIG. 2 having more than two resonator elements, it is also possible to provide at least two of the resonator elements with a different outside edge of the respective disc and/or a different shape of the respective recess of the disc beneath in the manner already described for the embodiment according to FIG. 1.

Since the number of slots and webs of the individual resonators is variable, the lower-frequency resonator could also be above, but then it would have fewer slots than the high-frequency resonator below.

What is claimed is:

1. A slotted antenna, comprising:

an electrically conducting base area;

at least one first electrically conducting web;

at least one second electrically conducting web;

a first electrically conducting disc including a recess and that is offset from the electrically conducting base area, the first electrically conducting disc being connected at an outside edge thereof to the electrically conducting base area by the at least one first electrically conducting web;

a second electrically conducting disc situated above the recess and connected at an outside edge thereof to the first electrically conducting disc by the at least one second electrically conducting web; and an antenna conductor leading to the second electrically conducting disc;

wherein the second electrically conducting disc has approximately a same area as that of the recess of the first electrically conducting disc.

2. The slotted antenna according to claim 1, wherein:

at least one of the outside edge of the first electrically conducting disc and the outside edge of the second electrically conducting disc is approximately circular.

3. The slotted antenna according to claim 1, wherein:

the recess is approximately circular in shape.

4. The slotted antenna according to claim 3, wherein:

a circular area of the recess of the first electrically conducting disc is smaller than a circular area of the second electrically conducting disc.

5. The slotted antenna according to claim 1, wherein:

at least one of the first electrically conducting disc and the second electrically conducting disc is elliptically shaped.

6. The slotted antenna according to claim 1, wherein:

the first electrically conducting disc and the second electrically conducting disc are approximately concentric.

7. The slotted antenna according to claim 1, wherein:

the at least one first electrically conducting web and the at least one second electrically conducting web are approximately perpendicular to the first electrically conducting disc, the second electrically conducting disc, and the electrically conducting base area.

8. The slotted antenna according to claim 1, wherein:

the at least one first electrically conducting web includes three webs situated between the first electrically conducting disc and the electrically conducting base area, and the at least one second electrically conducting web includes three webs situated between the first electrically conducting disc and the second electrically conducting disc.

9. The slotted antenna according to claim 8, wherein:

the three webs between the electrically conducting base area and the first electrically conducting disc are each situated so they are offset by approximately 120° relative to one another, and the three webs between the first electrically conducting disc and the second electrically conducting disc are situated so they are offset by approximately 120° relative to one another.

10. The slotted antenna according to claim 8, wherein:

the three webs between the electrically conducting base area and the first electrically conducting disc are mutually rotated by 60° with respect to the three webs between the first electrically conducting disc and the second electrically conducting disc.

11. The slotted antenna according to claim 1, wherein:

the slotted antenna is operable at a number of different frequency ranges corresponding to a number of electrically conducting discs used, a respective operating frequency depending on a slot length at the outside edge of the respective disc.

12. The slotted antenna according to claim 1, wherein:

slots formed by adjacent webs between the electrically conducting base area and the first electrically conducting disc each has a length of approximately half a first operating wavelength, and the slots formed by adjacent webs between the first electrically conducting disc and the second electrically conducting disc each has a length of approximately half a second operating wavelength.

13. The slotted antenna according to claim 1, wherein:

the recess of the first electrically conducting disc is arranged concentrically to the first electrically conducting disc.

14. The slotted antenna according to claim 1, further comprising:

at least one third disc arranged between the first electrically conducting disc and the second electrically conducting disc and including another recess;

at least one third web, wherein:

the at least one third disc is connected to the outside edge of the second electrically conducting disc by a web of the at least one second electrically conducting web, the second electrically conducting disc being adjacent to the at least one third disc, and the at least one third disc is connected on an outside edge thereof to the at least one first electrically conducting web by the at least one third web.

15. The slotted antenna according to claim 1, wherein:

the one of the first electrically conducting disc and the second electrically conducting disc having a greater diameter is the one of the first electrically conducting disc and the second electrically conducting disc that is closer to the electrically conducting base area.

* * * * *

UNITED STATES PATENT AND TRADEMARK OFFICE

CERTIFICATE OF CORRECTION

PATENT NO. : 6,750,826 B2
DATED : June 15, 2004
INVENTOR(S) : Ralf Schultze et al.

It is certified that error appears in the above-identified patent and that said Letters Patent is hereby corrected as shown below:

Column 1,
Line 38, change "a compact design. approximately circular" to -- a compact design. It is especially advantageous that the first disc and the second disc each have an approximately circular --

Signed and Sealed this

Fifth Day of April, 2005

JON W. DUDAS
*Director of the United States Patent and Trademark Office*